United States Patent [19]

Lucke

[11] 4,149,357

[45] Apr. 17, 1979

[54] DEVICE ON A SKEIN WINDING MACHINE FOR APPLYING BANDS

[75] Inventor: Florian Lucke, Mengen, Fed. Rep. of Germany

[73] Assignee: Croon & Lucke Maschinenfabrik GmbH & Co., KG, Mengen, Fed. Rep. of Germany

[21] Appl. No.: 838,081

[22] Filed: Sep. 30, 1977

[30] Foreign Application Priority Data

Oct. 13, 1976 [DE] Fed. Rep. of Germany ..... 2646067

[51] Int. Cl.[2] ..... B65B 13/02

[52] U.S. Cl. ..... 53/585; 53/292; 53/386

[58] Field of Search ..... 156/DIG. 5, DIG. 6, 156/DIG. 7, DIG. 19, DIG. 22, DIG. 14, DIG. 21, 569, 571; 53/198 R, 198 B, 291, 292, 294, 386, 585; 131/106

[56] References Cited

U.S. PATENT DOCUMENTS

| | | | |
|---|---|---|---|
| 1,875,110 | 8/1932 | Myers | 53/287 |
| 1,971,576 | 8/1934 | Nelson | 156/DIG. 14 |
| 2,089,769 | 8/1937 | Strout | 53/292 |
| 2,553,056 | 5/1951 | Lobasso | 156/DIG. 19 |
| 4,055,934 | 11/1977 | Leveugle | 53/198 B |

*Primary Examiner*—Michael W. Ball

*Attorney, Agent, or Firm*—Lawrence E. Laubscher

[57] ABSTRACT

A device on a skein winding machine for applying bands onto band flaps arranged on a movable carrier, in which a band lifter provided with a suction nozzle is arranged to remove a band from a magazine under the effect of suction at the suction nozzle and place the band on the band flaps, the band lifter being connected to a slide which presses the lifted band onto the band flaps during continued movement of the band lifter.

4 Claims, 12 Drawing Figures

DEVICE ON A SKEIN WINDING MACHINE FOR APPLYING BANDS

BACKGROUND OF THE INVENTION

This invention relates to a device on a skein winding machine for applying bands, particularly for applying bands onto band flaps arranged on a movable carrier, in which the band flaps, starting from an initial position, convey an applied band onto a fully wound skein by the movement of the carrier, deposit the banded skein at a delivery point and finally return to their initial position, and in which a band lifter, which is provided with a suction nozzle and which is movable up and down, removes a band from a magazine under the effect of suction at the suction nozzle and places the band on the band flaps located at their initial position by rotary movement actuated by a drive, preferably according to Federal Republic of Germany Pat. No. 25 32 432.

The present invention seeks to improve the device according to the Federal Republic of Germany, Pat. No. 25 32 432 in such a manner that the bands are still more securely slipped over the band flaps.

SUMMARY OF THE INVENTION

The present invention provides a device on a skein winding machine for applying bands onto band flaps arranged on a movable carrier, in which the band flaps, starting from an initial position, convey an applied band onto a fully wound skein by the movement of the carrier, deposit the banded skein at a delivery point and finally return to their initial position, and in which a band lifter, which is provided with a suction nozzle and which is movable up and down, removes a band from a magazine under the effect of suction at the suction nozzle and places the band on the band flaps located at their initial position by rotary movement actuated by a drive, wherein the band lifter is connected to a slide which presses the lifted band onto the band flaps during continued movement of the band lifter.

BRIEF DESCRIPTION OF THE FIGURES

The invention will be further described, by way of example only, with reference to the accompanying drawings, in which.

DETAILED DESCRIPTION

Figure 1:
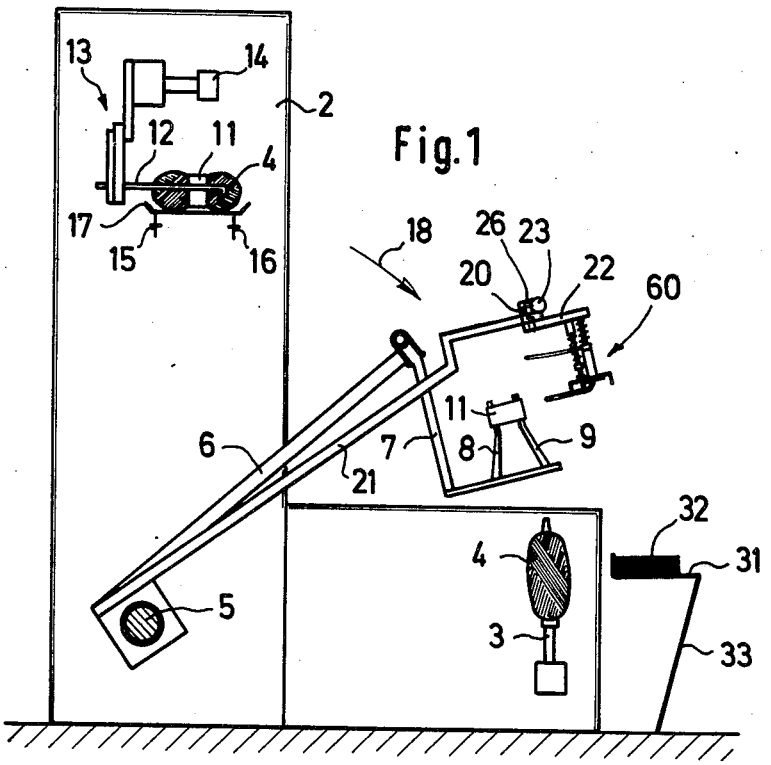
FIG. 1 is a schematic side view of a skein winding machine together with a device in accordance with the present invention.

In the device shown in the drawing, a rotatably driven winding mandrel 3 is mounted on a machine frame 2 in a known manner (cf. Swiss Pat. No. 557 779).

A skein 4 of yarn or the like is likewise formed in a manner known per se on the winding mandrel 3. A pivot arm 6, which can be pivoted in the vertical plane by a shaft 5 is secured to that shaft 5, which is mounted on the machine frame 2 and can be pivoted by means of a drive mechanism (not shown). An angle support 7, on which are arranged two band flaps 8 and 9 for the accommodation of a band 11 to be put onto the skein 4, is located on the free end of the arm 6.

Furthermore two rods 12 with hook shaped ends are provided on the machine frame 2. The rods 12 are movable towards each other at the desired time in a known manner by means of a shear linkage 13 and a drive 14. A conveyor located underneath the rods 12 comprises one or two chains 15, 16 and runs at right angles to the plane of FIG. 1. Trays 17, which serve to accommodate the banded skein 4, are secured to the chains 15, 16.

Figure 2:
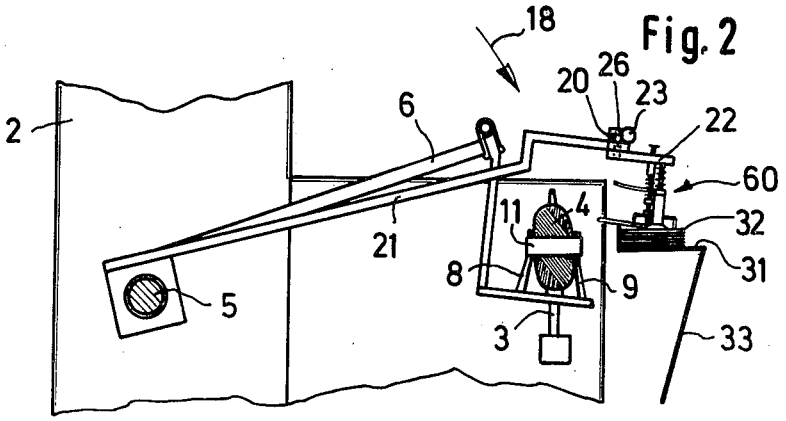
FIGS. 2 to 4 are schematic detailed side views illustrating different functional positions of the device shown in FIG. 1.
Figure 3:
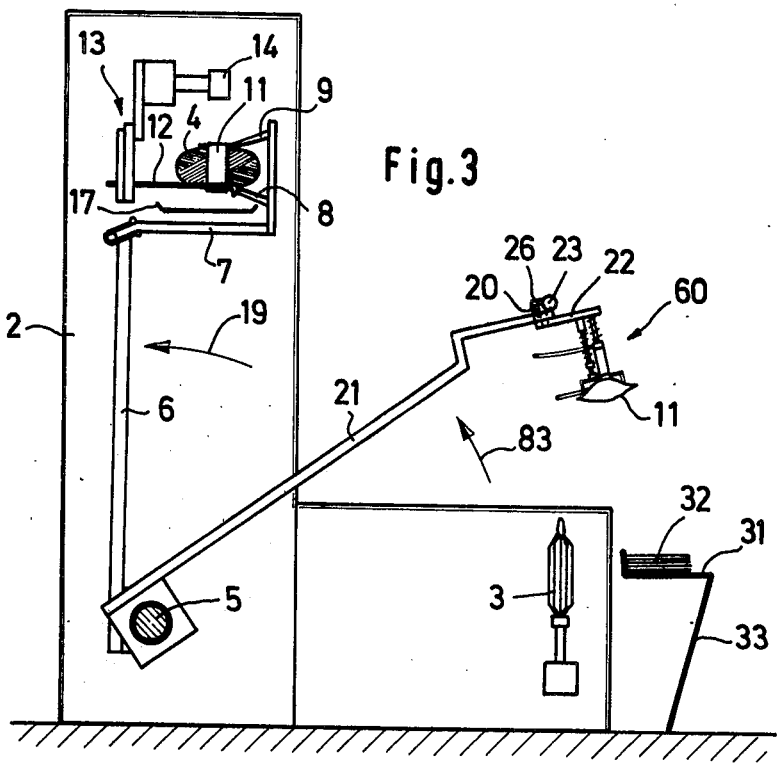
Figure 10:
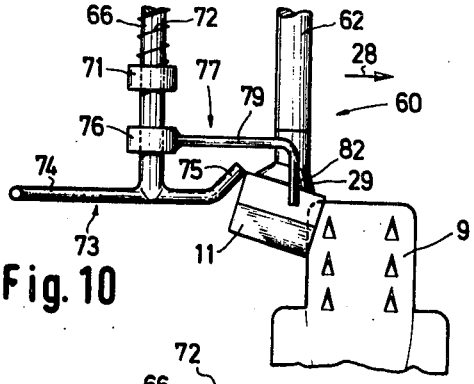
FIGS. 10 to 12 show different phases as the band is slipped over the band flaps.
Figure 11:
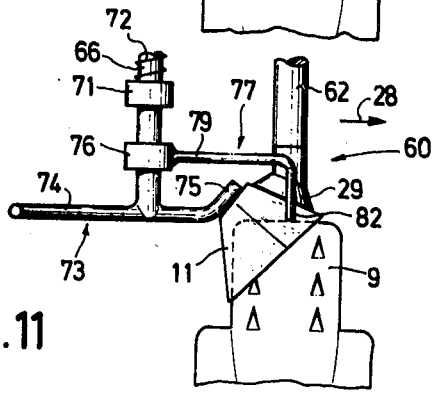

The device described so far operates in the following manner cf. Swiss Pat. No. 557 779). During the completion of the skein 4 on the winding mandrel 3, the pivot arm 6 with the flaps 8,9 assume the initial position shown in FIG. 1. A band 11 is put over the free ends of the flaps 8,9 (in a manner which is still to be described). When the skein 4 has been completely wound and the mandrel 3 has stopped, the arm 6 is pivoted downwards in the direction indicated by the arrow 18 (FIG. 2) so that the flaps 8, 9 are moved forwards against the skein 4. In this manner the flaps 8,9 slide over the skein 4 and in so doing slip the band 11 over the skein. On the return movement of the flaps 8,9 which now starts to take place, which is in the direction indicated by the arrow 19 and the end of which movement is shown in FIG 3, the skein 4 is drawn off from the mandrel 3 and carried away upwards by the flaps 8,9. For this purpose, counter-hooks, which engage the skein 4 can be provided on the inner side of the flaps 8, 9 (FIGS. 10 and 11). Due to the further upwards pivoting of the arm 6 in the direction of the arrow 19, the skein, held between the flaps 8, 9, together with the band 11, arrives between the two rods 12, which are now pressed laterally against the skein and the band by appropriate control means. The direction of movement of the arm 6 is now again reversed so that the arm returns to its initial position in the direction of the arrow 18 (cf. FIG. 4). In this manner the ends of the band flaps 8, 9, which at first are still between the band 11 and the skein 4, slide off from the skein because the skein is held fast by the rods 12 and leave the skein, now banded, on the tray 17 which carries the skein away. A new band 11 can then again be put onto the band flaps 8, 9 which have returned to the initial position, whereupon the above-described operation may be repeated.

A band lifter 60, the basic construction and function of which is described in the Federal Republic of Germany Pat. No. 25 32 432, is provided for the automatic application of the bands 11 onto the band flaps 8, 9. The band lifter 60 comprises a pivot arm 21 which can be pivoted up and down in a substantially vertical plane coaxially with respect to the shaft 5 but separately therefrom by its own separate driving mechanism, in a similar manner to the arm 6. The arms 6 and 21 are in this way correspondingly arranged staggered with respect to each other or made offset in such a manner that they do not hinder each other in their movements. The drive mechanism of the arm 21, likewise known per se, is co-ordinated with the movement cycle of the other machine parts, i.e. in particular of the arms 6 and the rods 12. A rotatable arm 22 is pin jointed at the free end of the pivot arm 21 with the interposition of a carrier 20. This arm 22 is rotatable in a plane which is substantially at right angles to the pivot plane of the arm 21. The carrier 20 and the parts which are rotatably connected therewith could also be movable up and down in a straight line by means of a substantially vertically arranged sliding guide, instead of via the pivot arms 21. In this case the drive of the carrier could for example be effected by a chain drive.

The rotation of the arm 22 is effected in the embodiment shown (FIG. 9) by a piston-and-cylinder unit 23 secured on the carrier 20, the piston rod 24 of which unit is connected to one end of a cable or a chain 25. The chain 25 is guided around a chain wheel 26 which is rigidly connected to the arm 22 and runs from there to a spring 27, which keeps the chain 26 taut. When the piston rod 24 is drawn into the cylinder 23 (to the right in FIG. 9), the arm 22 pivots out of the position shown by broken lines in FIG. 9 through the pivoting region into the position shown by full lines and, in addition, the free end of the arm 22 arrives over the band flaps 8, 9. Thus the pivoting region of the rotating arm 22 extends over an angle of about 270°.

Figure 6:
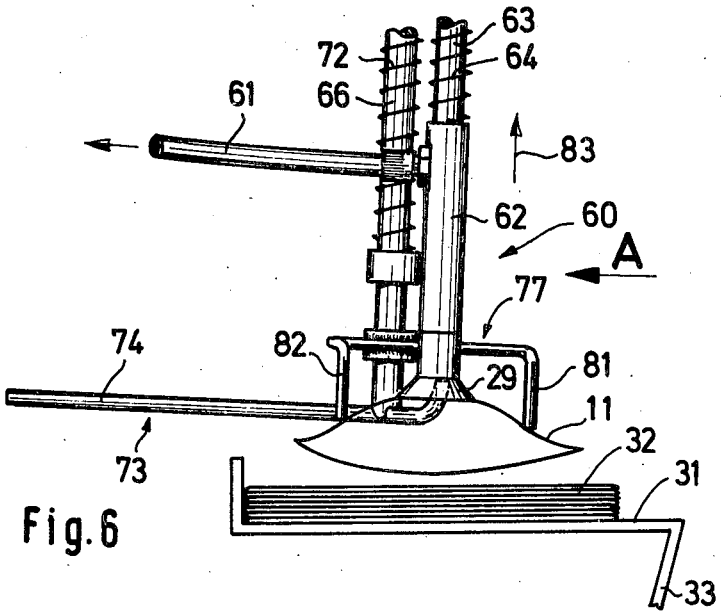
FIG. 6 is a view similar to FIG. 5 at another point in time of the operational sequence of the band lifter.
Figure 7:
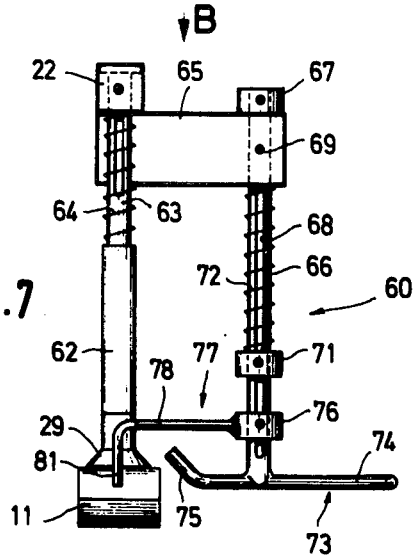
FIG. 7 is a view of the band lifter taken in the direction of the arrow A in FIG. 6.

An elastic suction nozzle 29, known per se, which is connected to a source of vacuum (not shown) via a conduit 61 (FIGS. 5 and 6) and projects downwards from the arm 22 by means of a pipe 62, is arranged on the free end of the arm 22 (cf. FIG. 7). The pipe 62 together with the suction nozzle 29 are slightly displaceable on a rod 63 which projects downwards from the arm 22. A spring 64, which is arranged between the pipe 62 and the arm 22, keeps the suction nozzle 29 in its lower end position relative to the arm 22. The suction nozzle 29 can be pushed upwards relative to the arm 22 against the force of the spring 64.

A magazine 31 (only shown schematically in the drawing) for a stack 32 of bands is provided in the movement region of the free end of the arm 22 and thus of the suction nozzle 29. The magazine 31 can be supported on the floor or on the machine frame 2 by a stand 33.

The construction of the band lifter 60 can be seen particularly from FIGS. 5 to 8.

A further arm 65, in which a rod 66 is slidably displaceable, projects from the arm 22. A check ring 67, which determines the lower end position of the rod 66 when lying on the upper side of the arm 65, is adjustably secured to the upper end of the rod 66. A groove 68, which extends axially and into which a bolt 69, recessed in the arm 65, projects, is made in the rod 66. In this way the rod 66 is mounted in the arm 65 so as to slide but not to rotate. A further ring 71 is adjustably mounted on the rod 66. The rod 66 is surrounded by a helical spring 72 between the ring 71 and the underside of the arm 65, which spring 72 presses the rod 66 into its lower end position. The rod 66 can be pushed upwards against the action of the spring 72. A slide 73 with a completely smooth underside is integrally connected to the lower end of the rod 66. The slide 73 is made as a curved round bar, the front end 75 of which is bent upwards. The radius of curvature of the rod 74 is substantially the same as the circle which the center of the suction nozzle 29 defines when the rotating arm 22 is pivoted. The bent-up front end 75 of the slide 73 is a small distance away from the suction nozzle 29, the end 75 projecting a little beyond the underside of the suction nozzle 29 (cf FIG. 7).

Figure 8:
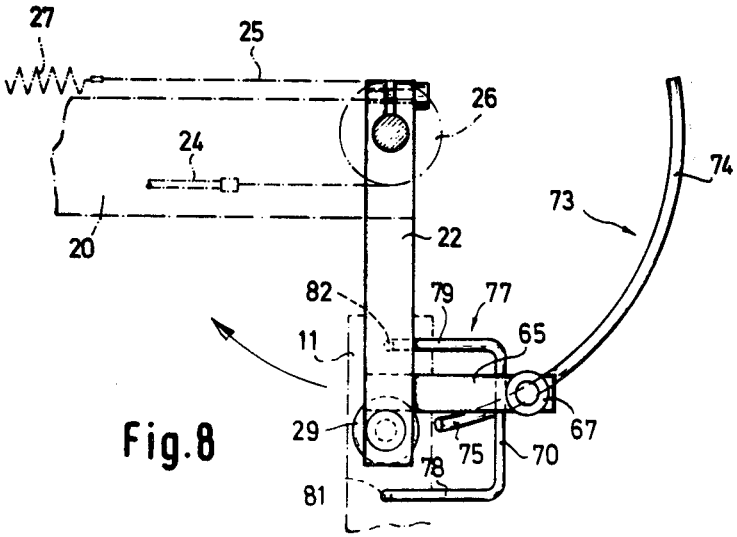
FIG. 8 is a plan view of the band lifter taken in the direction of the arrow B in FIG. 7.

Furthermore, a bush 76, from which a bifurcated band opener 77 projects to the side in the direction towards the nozzle 29, is located adjustably on the rod 66 between the ring 71 and the slide 73. The shape of the band opener 77 is best seen in FIGS. 7 and 8. Two side arms 78, 79, from which fork tines 81, 82 project downwards, project from a carrier arm 70 which is rigidly connected with the bush 76. In the lower end position of the rod 66 the free ends of the fork tines 81, 82 are located just below the underside of the suction nozzle 29 (FIG. 7).

The bands 11 normally comprise paper strips glued together to form a ring, and are laid flat in a stack 32 in such a way that the upper layer lies on the lower layer of the same band in each case.

Figure 5:
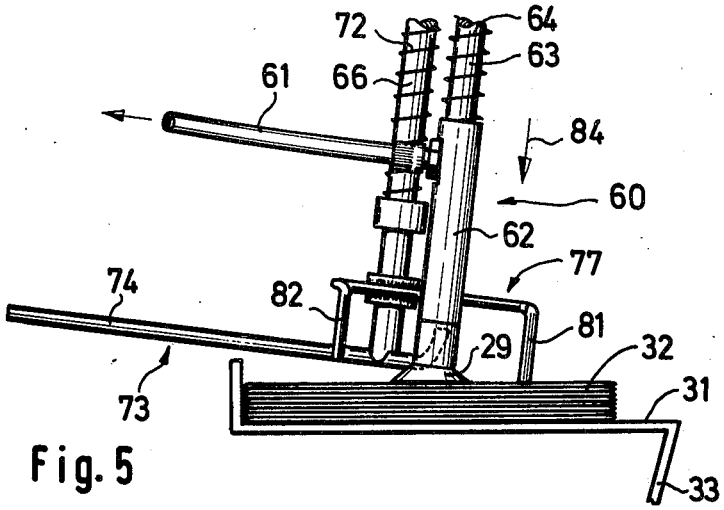
FIG. 5 is a fragmentary detailed side view of a band lifter.

The device described above operates in the following manner. While the band flaps 8, 9, secured to the arm 6 and carrying a band 11, are pushed over the skein 4 which is on the winding mandrel 3 (FIG. 2) and the skein 4 is subsequently conveyed (FIG. 3) in the direction of the delivery point (tray 17), the suction nozzle 29, which can be moved up and down and is connected to vacuum, is placed on the upper layer of the uppermost band of the stack 32 in the magazine 31 (FIGS. 2 and 5) and takes the upper band with it during the upwards return movement in the direction indicated by the arrow 83 (FIGS. 3 and 6). The removal operation of the uppermost band 11 from the stack is best seen in FIGS. 5 and 6. During the downwards movement of the band lifter 60 in the direction indicated by the arrow 84 one fork tine 81 of the band opener 77 first lies on the stack 32 so that during further downwards movement of the band lifter 60 in the direction of the arrow 84, the band opener 77 on the rod 66 is pushed upwards against the action of the springs 72, until the suction nozzle 29 is located on the uppermost band. By a further slight downwards movement of the band lifter 60, the suction nozzle 29 is pressed firmly against the upper layer of the uppermost band, the pipe 62 being pushed slightly upwards against the action of the spring 64 on the rod 63. If now the direction of movement of the band lifter 60 is reversed (cf. FIG. 6), and the latter is moved upwards in the direction of the arrow 83, the uppermost band 11 of the stack 32 remains hanging from the suction nozzle 29 and is thus entrained. Under the action of the spring 72, the band opener 77 is displaced, during this upwards movement, relative to the suction nozzle 29 again into its end position, in which the fork tines 81, 82 press the laterally projecting ends of the annular bands 11 slightly downwards, so that the previously folded flat band 11, which is made as a closed band, opens as shown in FIG. 6. The size of the opening can be varied in this case by corresponding adjustment of the band opener 77 on the rod 66 by means of the bush 76.

Figure 4:
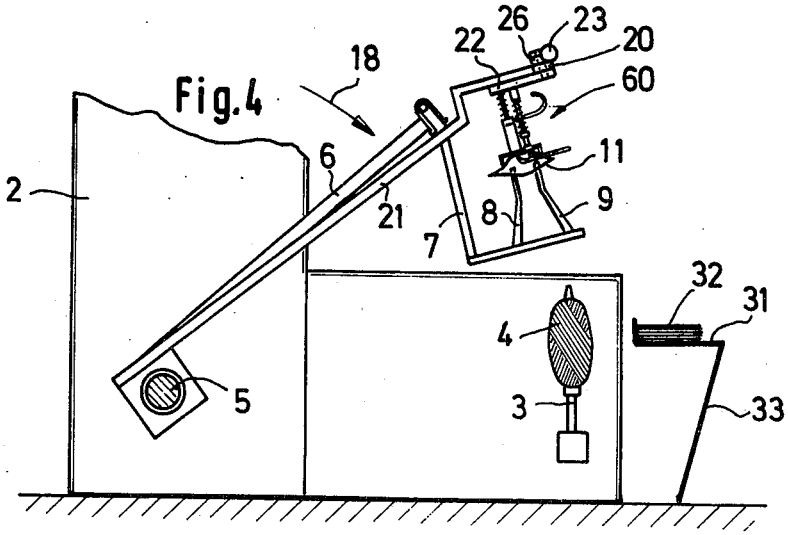
Figure 9:
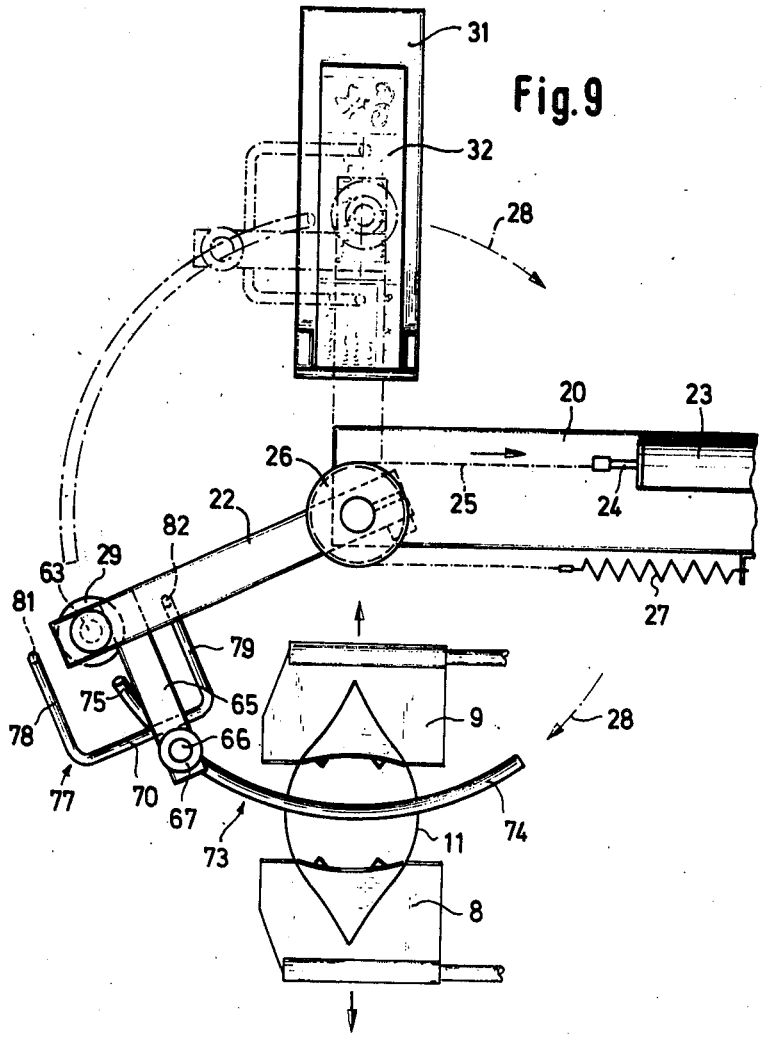
FIG. 9 is a schematic partial plan view of the device as a band is applied onto two band flaps.

When the band lifter 60 carrying a band 11 reaches the position shown in FIG. 3 and the arm 6 with the band flaps 8, 9 has returned to the initial position shown in FIG. 4, the flaps 8, 9 no longer carrying a band 11, the piston-and-cylinder unit 23 (cf. FIGS. 9 to 12) is actuated and the arm 22 is pivoted in the direction indicated by the upper arrow 28 in FIG. 9 from its position above the band magazine 31 to above the band flaps 8,9 (cf. the lower arrow 28 in FIG. 9). If, in so doing, the band lifter 60 (cf. FIG. 10) approaches the band flaps, the opened band 11, hanging from the suction nozzle 29, remains hanging on the opposite edges of the band flaps 8,9 whereupon they tilt slightly in the manner shown in FIG. 10. Upon further movement of the band lifter 60 in the direction indicated by the arrow 28 (cf. FIG. 11) the band 11 is pushed further over the band flaps 8,9, whereby the front end 75 of the slide engages in the band 11 and begins to push the latter over the band flaps. Upon further rotary movement in the direction of the arrow 28 (cf. FIG. 12), the curved rod 74 of the slide 73 engages in the upper edge of the band 11, pushes the latter completely onto the band flaps 8, 9 and keeps it in the above-described position while it slides over it.

When the arm 62 with the band lifter 60 secured thereto (cf. FIG. 9) has reached its end position, which is staggered by about 270° relative to the band magazine 31, the curved rod 74 of the slide is drawn completely out of the region of the band flaps 8,9, so that the latter now push the band 11 in the previously described manner (cf. FIGS. 1 to 3) onto the skein 4 and can deposit the banded skein on the tray 17. During this operating sequence of the band flaps 8, 9, the band lifter 60, if necessary executing a slight raising and lowering movement, is again returned to its initial position over the band magazine 31, which is indicated at the top of FIG. 9 by broken lines.

Figure 12:
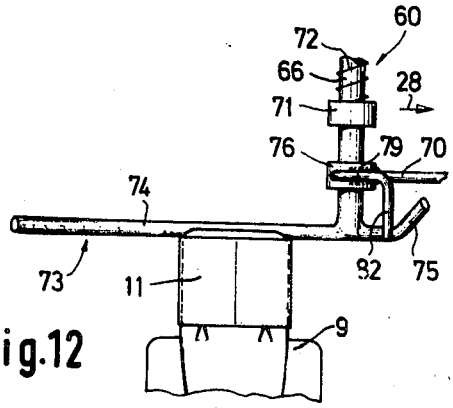

As can be seen from FIGS. 10, 11 and 12, it can be advantageous to make the edges of the band flaps 8,9, which come opposite the lower edge of the band 11 to be slipped on, completely flat so that the band 11 can be slipped over these flaps downwards without any hindrance. According to the strength of the suction pressure at the suction nozzle 29, the band 11 is released shortly after the operational state of the device shown in FIG. 11 is reached. If the suction pressure is too strong, it can be switched off at this time by an appropriate time control, the release of the band 11 from the suction nozzle 29 and its subsequent sliding onto the flaps 8,9 being facilitated by the slide 73. In the case of the illustrated embodiment (cf. particularly FIGS. 5 and 6), the band opener 77 is kept against the suction nozzle 29 by the fork tine 81 lying against the uppermost band. The advantage of this is that the relative movement between suction nozzle 29 and band opener 77 remains substantially the same. In an alternative embodiment of the invention there could be provided for the band opener 77, and thus also for the slide 73 rigidly connected thereto, a special stop in the region of the magazine 31 which, when the band lifter 60 is moved in the direction of the arrow 84 (FIG. 5), holds these parts and makes the setting down of the suction nozzle 29 on the uppermost band possible.

I claim:

1. In a band applying apparatus including pivotally displaceable carrier arm means (22) carrying suction nozzle means (29) for transporting a band (11) from a source thereof (31) to a pair of spaced parallel flaps (8, 9) the axes of which extend parallel with the pivot axis of said carrier arm means, said band normally having an orientation, when carried by said suction nozzle means, that is normal to the axes of said flap members; the improvement which comprises deflecting means (73) carried by said carrier arm means and operable as the carrier arm means pivots toward the flaps to a position in which the band engages the flaps for initially pivoting the band about the flaps to an orientation parallel with the flap axes and for subsequently forcing the band downwardly concentrically about the flaps, said deflecting means including an arcuate member (74) contained in a plane normal to the axes of said flaps, said arcuate member having a radius of curvature which originates at the axis of rotation of said carrier arm means and terminates at a point intermediate said flaps.

2. Apparatus as defined in claim 1, wherein the extremity (75) of said arcuate member adjacent said flaps is bent away from said flaps for pivoting the band about the flaps.

3. Apparatus as defined in claim 2, wherein said carrier arm means further includes bifurcated band-opening means (77) arranged on opposite sides of the nozzle means, respectively.

4. Apparatus as defined in claim 3, wherein one of said band-opening and nozzle means is connected with said carrier arm means for axial displacement parallel with the axes of said flaps, and means (72) biasing said one means in the direction of said flaps.

* * * * *